US010220252B2

(12) United States Patent
Jackson

(10) Patent No.: US 10,220,252 B2
(45) Date of Patent: Mar. 5, 2019

(54) COLLAPSIBLE GYM EQUIPMENT

(71) Applicant: PORTA-GYM LIMITED, London (GB)

(72) Inventor: Lee Jackson, London (GB)

(73) Assignee: PORTA-GYM LIMITED, London (GB)

( * ) Notice: Subject to any disclaimer, the term of this patent is extended or adjusted under 35 U.S.C. 154(b) by 180 days.

(21) Appl. No.: 15/260,414

(22) Filed: Sep. 9, 2016

(65) Prior Publication Data

US 2017/0072260 A1 Mar. 16, 2017

(30) Foreign Application Priority Data

Sep. 11, 2015 (GB) ..... 1516130.0

(51) Int. Cl.
*A63B 1/00* (2006.01)
*A63B 17/04* (2006.01)
(Continued)

(52) U.S. Cl.
CPC ..... *A63B 23/1218* (2013.01); *A63B 17/04* (2013.01); *A63B 21/00047* (2013.01);
(Continued)

(58) Field of Classification Search
CPC .. A63B 1/00; A63B 1/005; A63B 3/00; A63B 7/00; A63B 7/02; A63B 7/04; A63B 7/045; A63B 7/08; A63B 7/085; A63B 9/00; A63B 2009/006; A63B 17/00; A63B 17/04; A63B 21/00047; A63B 21/0005; A63B 21/00054; A63B 21/00058; A63B 21/00061; A63B 21/00065;
(Continued)

(56) References Cited

U.S. PATENT DOCUMENTS 3,226,115 A 12/1965 Underhill
3,384,332 A 5/1968 Fenner
(Continued)

FOREIGN PATENT DOCUMENTS

CN 203408426 1/2014
FR 3004655 10/2014
(Continued)

OTHER PUBLICATIONS

GB Search Report dated Feb. 10, 2016, 4 pages.

*Primary Examiner* — Gary D Urbiel Goldner

(74) *Attorney, Agent, or Firm* — Rankin, Hill & Clark LLP

(57) ABSTRACT

A portable bodyweight exercise device collapses into a neat and compact folded state. The device is simple to use, relatively inexpensive, and is self-contained and useful in virtually any environment and without need of other materials or conditions. The primary functionalities stem from the device's provision of an elevated weight-bearing anchorage from which to suspend all or part of one's weight, either by direct contact or through connecting equipment such as webbing straps. This allows for a variety of exercises to be performed for every major part of the body and can obviate use of expensive larger home gym equipment or commercial gym membership. In addition to muscle development, the device is favorable to other health and fitness purposes such as physiotherapeutic and palliative care.

21 Claims, 9 Drawing Sheets

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 21/068*** | (2006.01) |
| ***A63B 23/02*** | (2006.01) |
| ***A63B 23/035*** | (2006.01) |
| ***A63B 71/02*** | (2006.01) |
| ***A63B 23/12*** | (2006.01) |

(52) U.S. Cl.
CPC ..... *A63B 21/068* (2013.01); *A63B 21/4035* (2015.10); *A63B 23/03525* (2013.01); *A63B 1/00* (2013.01); *A63B 21/00061* (2013.01); *A63B 21/0442* (2013.01); *A63B 21/0552* (2013.01); *A63B 23/0205* (2013.01); *A63B 23/03541* (2013.01); *A63B 23/1227* (2013.01); *A63B 23/1236* (2013.01); *A63B 71/023* (2013.01); *A63B 2208/029* (2013.01); *A63B 2208/0285* (2013.01); *A63B 2209/02* (2013.01); *A63B 2210/52* (2013.01); *A63B 2225/09* (2013.01); *A63B 2225/093* (2013.01)

(58) Field of Classification Search
CPC ..... A63B 21/00069; A63B 21/00072; A63B 21/00076; A63B 21/00178; A63B 21/00181; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/065; A63B 21/068; A63B 21/08; A63B 21/15; A63B 21/159; A63B 21/4027; A63B 21/4033; A63B 21/4034; A63B 21/4035; A63B 21/4043; A63B 21/4045; A63B 21/4047; A63B 2023/003; A63B 2023/006; A63B 23/0205; A63B 23/0211; A63B 23/0216; A63B 23/0222; A63B 23/0227; A63B 23/035; A63B 23/03508; A63B 23/03516; A63B 23/03525; A63B 23/03533; A63B 23/03541; A63B 23/0355; A63B 23/03575; A63B 23/12; A63B 23/2109; A63B 23/1218; A63B 23/1227; A63B 23/1236; A63B 23/1245; A63B 23/1281; A63B 26/00; A63B 26/003; A63B 69/0057; A63B 69/0059; A63B 69/0064; A63B 2069/0062; A63B 71/0054; A63B 71/02; A63B 71/023; A63B 71/026; A63B 71/027; A63B 71/04; A63B 2071/0063; A63B 2071/0072; A63B 2071/009; A63B 2208/0285; A63B 2208/029; A63B 2210/00; A63B 2210/50; A63B 2210/52; A63B 2210/54; A63B 2225/09; A63B 2225/093
See application file for complete search history.

(56) References Cited

U.S. PATENT DOCUMENTS 3,448,748 A * 6/1969 Walrave ..... E04H 15/003 135/114
3,738,650 A * 6/1973 Ossenkop ..... A63B 1/005 248/264
3,915,452 A 10/1975 Winblad
3,944,219 A * 3/1976 Lopresti ..... A63B 1/00 211/123
3,979,114 A 9/1976 Codina
4,258,915 A * 3/1981 Sellge, Jr. ..... A63B 69/00 248/440.1
4,846,205 A * 7/1989 Knoll ..... E04H 15/003 135/114
4,921,245 A * 5/1990 Roberts ..... A63B 7/02 482/23
5,072,934 A 12/1991 Blanes
5,178,590 A * 1/1993 Stephens ..... A63B 7/02 482/23
5,221,240 A 6/1993 Mann
5,244,213 A * 9/1993 Armell ..... A63B 63/004 273/400
5,346,227 A * 9/1994 Amram ..... A63B 63/004 273/400
5,468,205 A 11/1995 McFall
5,695,195 A * 12/1997 John ..... A63B 63/004 273/400
5,842,939 A * 12/1998 Pui ..... A63B 63/004 473/478
5,954,600 A * 9/1999 Gill ..... A63B 63/004 273/400
6,209,878 B1 * 4/2001 Munro ..... A63B 63/004 273/400
6,669,152 B2 * 12/2003 Hernandez ..... F16M 11/38 248/163.2
6,952,844 B2 * 10/2005 Danaher ..... A47C 29/006 135/127
7,125,351 B1 * 10/2006 Raber ..... A63B 63/004 473/478
9,675,829 B1 * 6/2017 Katz ..... A63B 1/00
2003/0013579 A1 * 1/2003 Rennex ..... A63B 7/04 482/37
2005/0003938 A1 * 1/2005 Henderson ..... A63B 21/068 482/143
2005/0067785 A1 3/2005 Moore
2006/0160681 A1 * 7/2006 McBride ..... A63B 1/00 482/123
2006/0226607 A1 * 10/2006 Chen ..... A63B 63/004 273/407
2012/0329618 A1 * 12/2012 White ..... A63B 21/0552 482/126
2012/0329620 A1 * 12/2012 White ..... A63B 21/151 482/131
2013/0053220 A1 2/2013 Monaco
2013/0157818 A1 * 6/2013 Lalaoua ..... A63B 71/023 482/123
2013/0237394 A1 9/2013 Fowler
2014/0194261 A1 * 7/2014 O'Neil ..... A63B 21/00069 482/139
2015/0297948 A1 * 10/2015 Meister ..... A63B 23/03566 482/122

FOREIGN PATENT DOCUMENTS

| | | |
|---|---|---|
| GB | 2475546 | 5/2011 |
| GR | 20020100341 | 3/2004 |
| WO | 95/32031 | 11/1995 |
| WO | 2010/035243 | 4/2010 |
| WO | 2015/110796 | 7/2015 |

* cited by examiner

COLLAPSIBLE GYM EQUIPMENT

TECHNICAL FIELD

This invention relates to exercise apparatus, more particularly to a relatively compact, light-weight, collapsible, portable apparatus for use in bodyweight exercises.

BACKGROUND TO THE INVENTION

There are numerous well-known health and fitness benefits associated with bodyweight exercises, that is, exercises in which the individual's own weight provides the resistance for the movement. Common examples are: the pull-up or chin-up, in which the individual pulls the bodyweight from above with palms forward or backward in a pronated or supinated grip; the 'inverted row', in which the individual lifts the bodyweight upwards via a rowing motion while positioned horizontally with heels on the floor; and, of course, the push-up. The suite of available bodyweight exercises is augmented by so-called 'suspension training' exercises in which straps are employed to bear part or all of the bodyweight. Bodyweight exercises allow a full range of muscle groups to be targeted and are widely considered to be essential constituents of a complete workout regime. Bodyweight exercises also have other health benefits such as improving posture or suppleness in the joints. For example, some medical practitioners have proposed that a variety of shoulder problems are caused by modern lifestyles and in particular a lack of use of core shoulder functionality and that a selective remedy is to regularly suspend one's bodyweight from above in order to stretch the rotator cuff and relieve impingements. Therefore, the usefulness of exercises that require an elevated weight-bearing anchorage from which to suspend all or part of one's weight, either by direct contact or through connecting equipment such as webbing straps, is well established.

There is a prevalent and growing market for personal fitness and its equipment. With a growing network of public gym facilities there has been a concomitant growth in demand for alternative fitness equipment as users seek to avoid gym membership fees.

The majority of prior art examples of portable personal bodyweight exercise apparatus usually involve the attachment permanently or temporarily of a device to a doorway frame or jamb. For example GR20020100341 discloses a bar with two end fittings that are secured to the door's jamb through a nut. U.S. Pat. No. 3,738,550 requires two metallic brackets to be fastened to a door jamb, or U.S. Pat. No. 5,072,934 discloses U-shaped brackets which are screwed into opposing door jambs. Bolting screws into a door frame or side jambs is something that many people are unwilling or unable to do. Apparatus such as U.S. Pat. No. 3,915,452 that rest on the head jamb are similarly not suited to many doorframes due to the lack of weight-bearing ability in the head jamb. Thus, most such devices that are known in the art lack consideration of the structural or cosmetic integrity of the door frames. Devices involving attachment to a doorway frame or jamb can lack versatility and may not have a broad range of potential uses. For example, such devices are not available for use by tenants of rented properties without a high risk of incurring cost as a result of damage to the doorframe. Similarly, such devices cannot be used in guest accommodation such as in hotels or when staying with friends or family.

Aside from structural and cosmetic considerations, doorway devices also have the limitation that exercises must be performed within a doorway, and this may restrict the range of exercises available. For example, the straps disclosed in GB2475546 could usefully be employed for suspension push-ups only if the vicinity of the door frame is unimpeded by other walls or furniture and the door frame itself is wide enough to encompass the elbow-to-elbow span of the user. A significant percentage of door frames encountered in modern dwellings do not meet such criteria. The requirement for a doorframe to be present at all precludes the use of doorway devices from many and diverse situations in which doorframes are not present, for example when camping, caravanning, or generally outdoors. Various other exercise apparatus with the above shortcomings is available in the prior art for positioning and orientation for use positioned in doorways, such as is exemplified in the following: U.S. Pat. No. 5,468,205 (pulley support units mounted on a door by straps which vertically encircle the door); U.S. Pat. No. 5,221,240 (a door gym apparatus with upper and lower mounts of telescoping configuration having swivel, caps), U.S. Pat. No. 3,226,115 (door-mounted 'compact gymnasium', including bench); U.S. Pat. No. 3,979,114 (a device comprising two flexible lines, each line having a stirrup member at one end).

Other than apparatus for use positioned in doorways, other examples of apparatus are known in the art, such as the apparatus disclosed in US20130053220 (mobile fitness system capable of being mounted to a vehicle rack) and US2013237394 (triangular support frames and an attached bar giving pyramidal prismatic structure for user to lean down on). The former relies heavily on extraneous equipment and each makes available only a subset of common bodyweight exercises. Noteworthy commercially available apparatus that provide for bodyweight exercises by way of elevated anchorages by which to suspend the body are as follows: Products relying on inverted T-shaped bars for a frame, which can have a propensity for lateral instabilities. Further, due to the fact that the four support points of such frames define a plane, the use of the device is restricted to operation on near-perfectly flat floors, which significantly restricts the range of available environments (precluding, for example, most outdoor environments with naturally occurring floor surfaces such as grass). Similar issues of stability, versatility, and limited variety of available exercises apply also to U.S. Pat. No. 3,384,332 (gymnastics gallows for ring exercises). Other prior devices either lack versatility or are not portable and so are limited in their range of use. Other known frame shapes include children's play swings.

As these examples and the foregoing discussion illustrates, there is a need for portable and versatile bodyweight exercise apparatus for use in a broad range of environments and conditions.

SUMMARY OF THE INVENTION

According to a first aspect of the present invention there is provided a collapsible apparatus for bodyweight exercises, arranged to be assembled into an assembled state and disassembled to a disassembled state, wherein, in the assembled state, the equipment comprises a frame for bodyweight exercises, the frame preferably comprising:

- a plurality of feet and at least one crossbar, arranged to be held substantially horizontally at a height from the ground when the feet are located on the ground;
- a plurality of leg members extending between the feet and the crossbar; and
- at least two connectors in spaced configuration on the crossbar, for connecting the crossbar to at least one leg;

wherein at least one of the legs and/or the crossbar is detachable from at least one of the connectors to disassemble the apparatus; and wherein in the disassembled state, the crossbar is preferably retained to at least one of the leg members by a flexible retaining member such that, when disassembled, the crossbar and legs are retained to one another.

The invention relates to a portable bodyweight exercise device which collapses into a neat and compact folded state. The device is simple to use, relatively inexpensive, and is self-contained and useful in virtually any environment and without need of other materials or conditions. The primary functionalities stem from device's provision of an elevated weight-bearing anchorage from which to suspend all or part of one's weight, either by direct contact or through connecting equipment such as webbing straps. This allows for a variety of exercises to be performed for every major part of the body and can obviate use of expensive larger home gym equipment or commercial gym membership. In addition to muscle development, the device is favourable to other health and fitness purposes such as physiotherapeutic and palliative care. The present invention substantially fulfils the needs addressed above in a cost-effective, lightweight, easy-to-use, and self-contained way, and such that can be used in virtually any environment.

In the disassembled state, all of the legs and the crossbar may be retained to one another by one or more flexible connecting members. The feet may be retained to the legs by one or more flexible retaining members.

At least one pair of legs may be retained to the crossbar by a single flexible retaining member. At least one component of the assembly may be retained to at least one second component of the assembly by a flexible member passing through an internal bore of at least one of the first and second components of the assembly.

A plurality of leg members may be retained to the crossbar by a flexible member passing through an internal bore of the leg members. One or more of the feet is retained to a respective leg member by a flexible member passing through an internal bore of the one or more feet.

At least one foot may be retained to a respective leg by a flexible retaining member which also retains the respective leg to the crossbar.

In the assembled state, the frame may comprise at least one tension member arranged to retain feet of at least one pair of legs at a substantially fixed distance from one another. The tension member may be a flexible strap.

The apparatus may comprise a plurality of foot members, at least one of the foot members comprising a leg receiving portion arranged to receive a leg of the assembly, and an attachment portion, arranged for attaching the tension member to the foot member. The attachment portion may be a hook.

The foot member may comprise a first plugging connection point for connecting to a tubular leg member. The foot member may comprise as book section for attaching a tension member.

The foot member may comprises a leg member-receiving portion configured to receive a leg member of the apparatus at an oblique or non-perpendicular angle relative to a plane of a bottom surface of the foot member.

One or more of the connections between the crossbar, leg members and feet may comprise a plug-in connection.

One or more connectors of the apparatus, for connecting a leg member to the crossbar, may be configured to permit rotation of at least one of the leg members relative to at least one other leg member, about the longitudinal axis of the crossbar.

Preferably, a first pair of leg members is able to rotate relative to a second pair of leg members. The first pair of leg members may be held at relatively fixed orientations relative to one another while being able to rotate relative to the second pair of leg members, which may also be held at relatively fixed orientations relative to one another.

The apparatus may comprise one or more elastic retaining members arranged to retain one or more components of the apparatus to one or more second components of the apparatus.

The elastic retaining members may be configured to bias one or more members of the apparatus toward the assembled configuration when the apparatus is in its assembled state.

At least one foot of the apparatus may be retained to a flexible retaining member by a diameter increase provided on the flexible retaining member. The diameter increase may be provided by a knot in the flexible retaining member.

At least one foot member may comprise a cavity for receiving an end stop of a flexible retaining member, such as the diameter increase.

One or more of the leg members may extend away from the longitudinal axis of the crossbar, in a substantially diagonal direction with respect to the axis of the crossbar.

One or more of the leg members may extend diagonally away limn a centre region of the crossbar.

Any or all of the above features of the invention can be combined, in any combination, to provide advantages which will become further apparent on reading the following detailed description.

BRIEF DESCRIPTION OF THE DRAWINGS

The invention will now be described, by way of example only, with reference to the accompanying drawings in which.

DETAILED DESCRIPTION OF THE INVENTION

Figure 1:
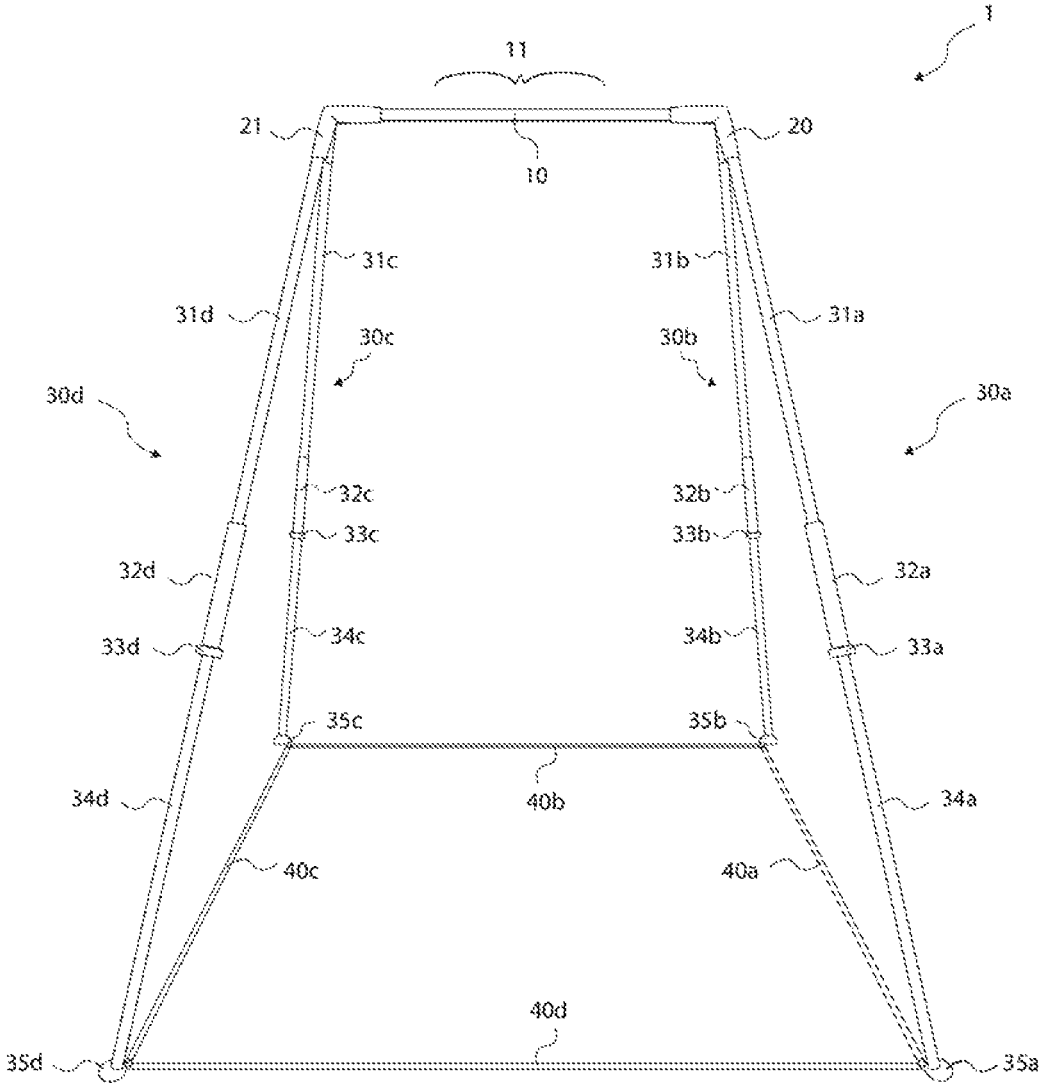
FIG. 1 shows a front view of an embodiment of a collapsible apparatus according to the invention.

FIG. 1 shows a collapsible apparatus for bodyweight exercises 1 according to an embodiment of the invention. FIG. 1 shows the apparatus 1 in an assembled state. As can be seen in the Figure, the apparatus comprises a crossbar 10. Crossbar 10 is made from a suitably dimensioned material for carrying the weight of as person, preferably at any point on its span. A suitable material may be tubular steel, although other materials such as other metals, suitably dimensioned plastic, carbon fibre tubing or any other material within the skills of the skilled person. The desired weights to be carried on the crossbar is therefore in the range of around 50 kg to 100 kg or more. Average human weights can range from around 70 to 90 kg for males and 60 to 75 kg for females, but to account for natural variations and a safety factor, a weight of up to 200 kg should preferably be supportable on crossbar 10. Human arm strength rarely exceeds 200 kg and so this usually provides suitable strength in a majority of cases. A suitable material can be selected by a skilled person to support this weight, such as steel bar, and in a specific example, a 25 mm outer diameter 2 mm wall thickness steel tube can be used, which can in certain configurations support up to 400 kg.

The crossbar has at each end a connector piece 20 and 21. The connector pieces 20 and 21 are preferably in a spaced configuration on crossbar 10, leaving a substantially straight section of bar in between to permit a user to perform bodyweight exercises using the crossbar 10. The crossbar, and preferably the connector pieces, is/are supported by a plurality of legs 30*a*, 30*b*, 30*c* and 30*d*. As can be seen in the Figure, the legs preferably extend from the crossbar 10 in a direction which extends away from the longitudinal axis of the crossbar 10 in a substantially diagonal direction. Each leg preferably extends diagonally away from the axis of the crossbar 10 and also away from the centre region 11 of the crossbar 10. Otherwise stated, the legs can extend from the floor, inwardly toward the crossbar when in the assembled state and standing on the floor. When configured in this way, reaction forces acting along the legs to react a weight applied to the crossbar act to maintain both the legs 30*a* to 30*d* and the crossbar 10 in the receiving portions of the connectors 20 and 21. One or more of the legs received in the connector pieces 20 are repeatably and releasably received by the connector pieces 20. This means that they are configured to be connected to and disconnected from the connector pieces in a repeatable way without causing significant damage to either component. The connection and disconnection may further be achievable without the use of tools, i.e. by bare hands of a user. When a user places weight on the crossbar 10, the assembly is biased by the weight of the user towards its assembled configuration, which reduces the risk of inadvertent disconnection of the crossbar 10 or legs 30*a* to 30*d* from the connectors 20 and 21.

Each leg is preferably made up of a plurality of elongate sections. In the illustrated example, each leg is made up of two sections, an upper portion at 31*a* to 31*d* and a lower portion, 34*a* to 34*d*. Separate leg portions are connected via connector means 32*a* to 32*d*. The leg portions may be locked to one another in a coaxial or collinear arrangement. The connector means can be provided in any form which allows the connection or collinear locking of two elongate members to one another, transferring longitudinal and bending or lateral forces between the two. In the illustrated embodiment, each connector means 32 is provided in the form of a sheath which may slide over the connection between lower 34 and upper 31 leg members and is retained in place by abutting against a stop 33*a* to 33*d* on irrespective leg 30. Other suitable arrangements include receiving one end of one leg piece within the other, for example, preferably via swaged tube ends or other means.

A plurality of foot members 35*a* to 35*d* is provided to assist with engagement of the legs 30 with the floor when the apparatus is standing on the floor, as illustrated in FIG. 1. Foot members 35*a* to 35*d* will be described in greater detail in relation to later figures. A plurality of tension members 40*a* to 40*d* may be provided. Tension members 40 act to react any outward horizontal or lateral component of the forces in the legs 30, to prevent 'splaying' of the legs outwardly when the user places weight on the crossbar 10. There are various ways to prevent splaying, for example the natural rigidity of the legs and elbows may do this to some extent. An advantage of the tension straps is that they can help prevent splaying for much greater weights, due to them acting at a point distal, preferably furthest on the leg members, from the fulcrum at the upper end of the leg members. Tension members 40 may be substantially flexible straps in the illustrated example, but may also be rigid members in certain embodiments, if preferred. The illustrated configuration allows a certain degree of movement between the feet 35 in substantially vertical directions, so that the apparatus can be securely placed on slightly uneven ground, whilst still remaining safe, sturdy and intact. A certain degree of lateral movement in the tension members 40 can enable the assembly 1 to adapt to uneven ground whilst still remaining stable. Further, one or more of the connector pieces 20 and/or 21 may allow the leg members to rotate about the longitudinal axis of the crossbar. This results in the pair of legs 30*a*/30*b* and the pair 30*c*/30*d*, and their respective pairs of feet, being free (even when connected to the crossbar) to find points of equilibrium relatively independently, to support the weight of the frame and/or a user on uneven ground. One or more of the connector pieces may each hold a respective plurality of legs attached to it at relatively fixed orientations relative to one another.

Figure 2:
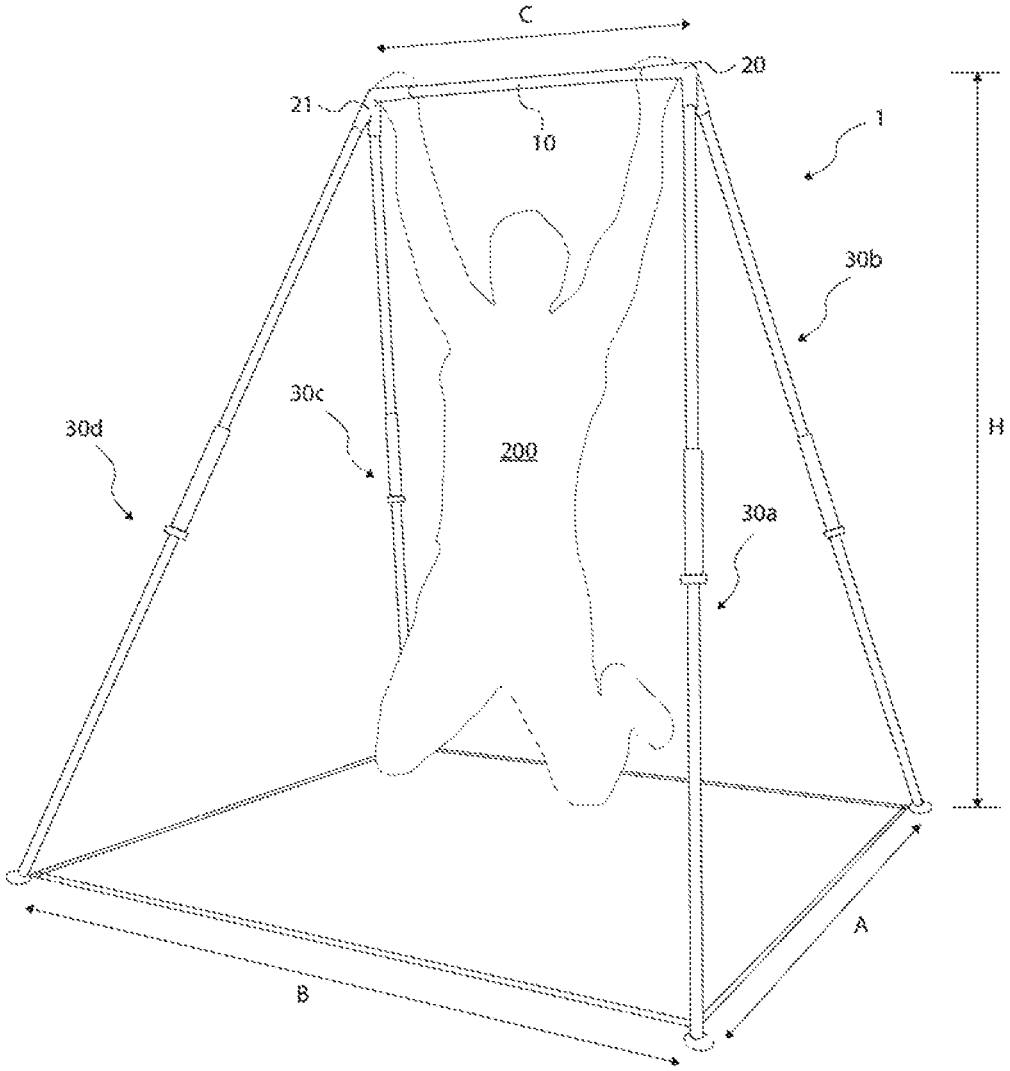
FIG. 2 shows a first mode of use for the equipment of FIG. 1 in bodyweight exercises.

FIG. 2 shows an illustration of a user 200 in a pull-up position, where it can be seen that weight of the user is placed on or about crossbar 10 and connectors 20 and 21. As can be seen, the crossbar 10 is located at approximately head-height when a user is standing, as opposed to hanging. As shown in the illustration, the user is lifting his or her feet to carry out the desired body weight exercise. A crossbar 10 may be higher than this, so that a user does not need to bend his or her legs. Alternatively, the crossbar could be lower. However, below a certain height, bodyweight exercises such as pull-ups cannot be performed on crossbar 10. A preferred height (above even ground) for the crossbar in the assembled form illustrated in FIGS. 1 and 2 is therefore between approximately 1.5 meters and 2.5 meters. The preferred actual height in the illustrated embodiment is between around 1.6 m and 1.8 m, preferably 1.7 m.

The apparatus may be provided with a fore-aft foot-span A and a lateral foot-span B. These dimensions, as a proportion of height H, will affect the overall stability of the frame. Fore-aft footspan A is preferably approximately 0.6 to 1.4 times the overall height H of the assembled equipment. Similarly, a preferred lateral span B is 0.6 to 1.4 times overall height H.

Figure 3:
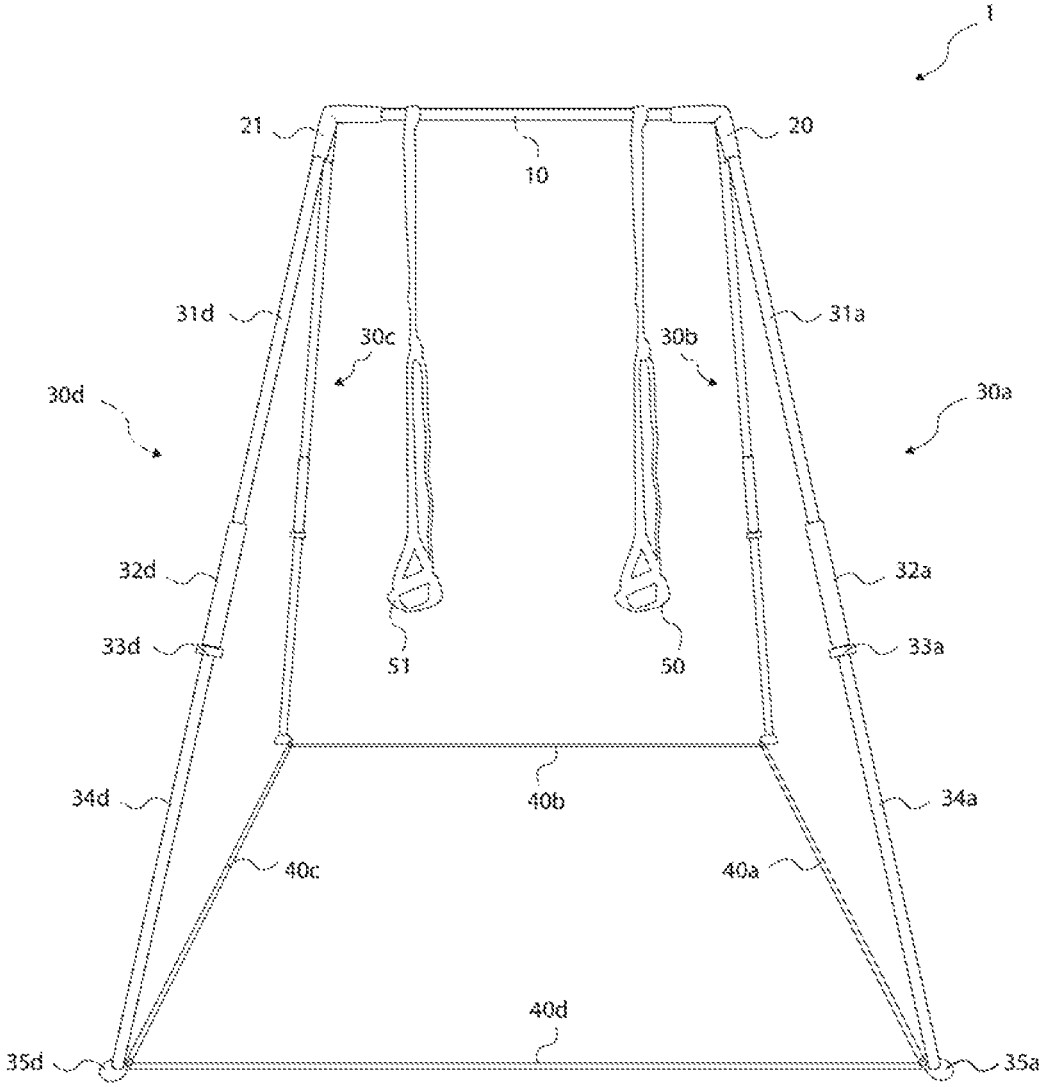
FIG. 3 shows a further configuration for the assembled apparatus of an embodiment of the invention.
Figure 4:
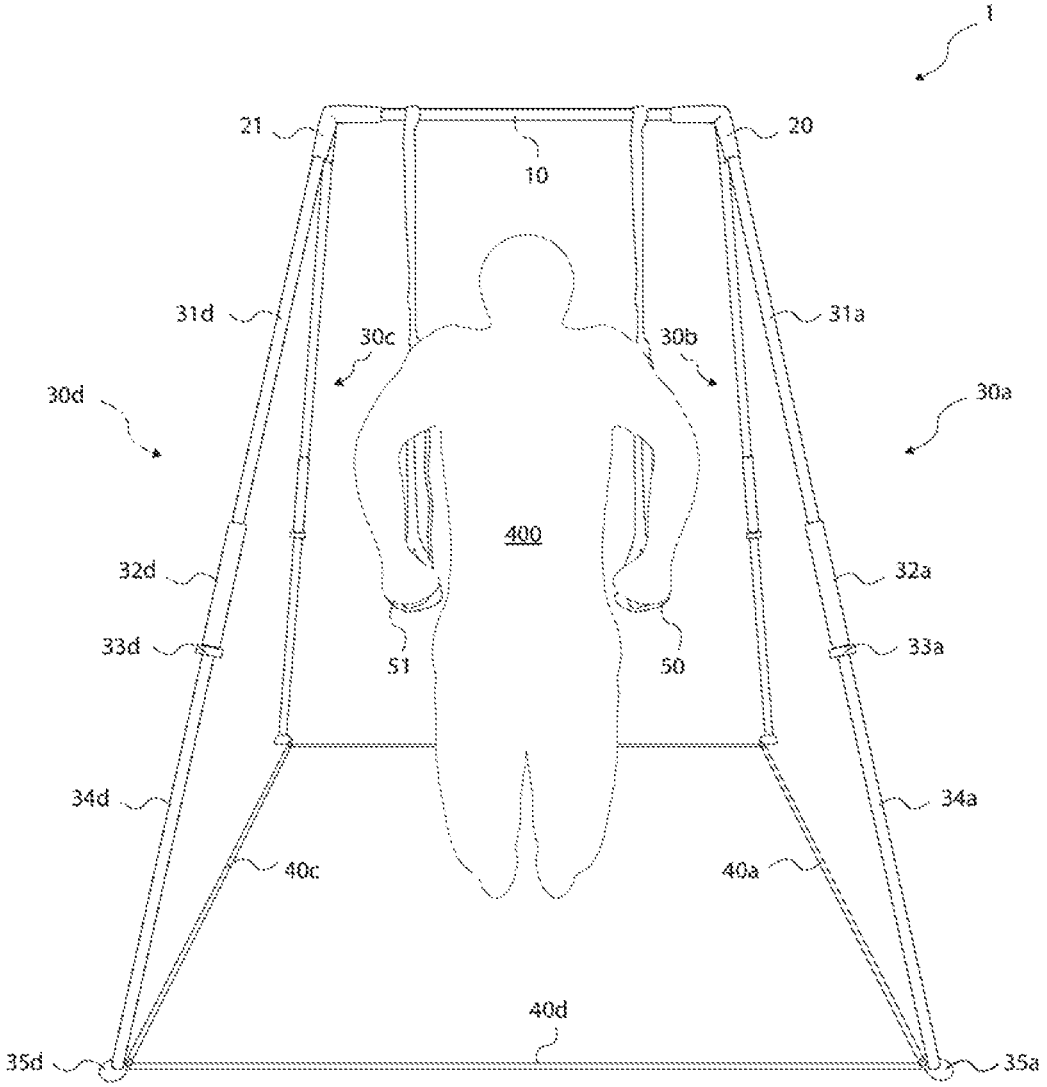
FIG. 4 shows a further mode of use for apparatus of an embodiment of the invention.
Figure 5:
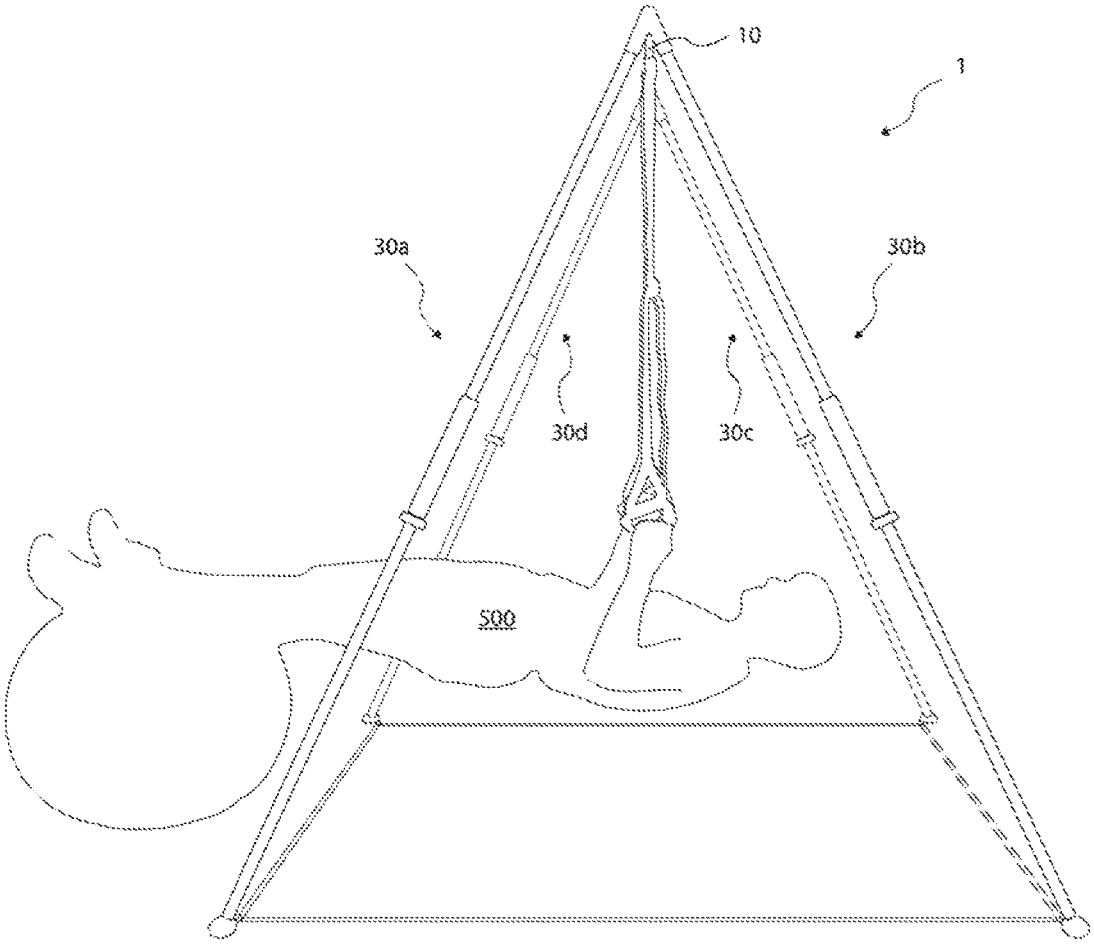
FIG. 5 shows a further mode of use for apparatus of an embodiment of the invention.

FIG. 3 shows the equipment 1 in an assembled state with adjustable suspension training straps 50 and 51 attached. FIG. 4 illustrates a user 400 performing a stability dip exercise using suspension training straps 50 and 51. FIG. 5 shows a user 500 carrying out an inverted row using the apparatus of the invention.

Figure 6:
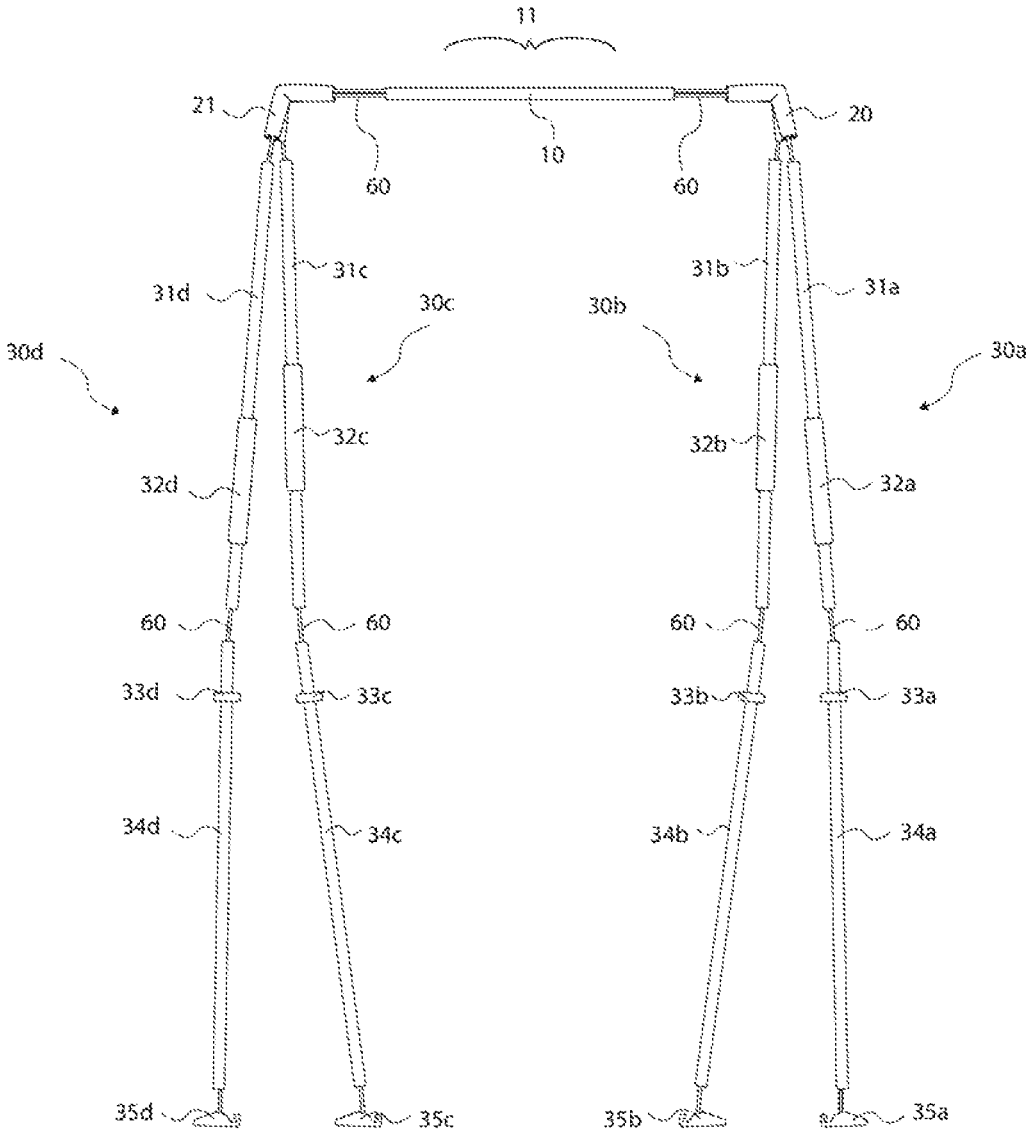
FIG. 6 shows an apparatus of an embodiment of the invention in a disassembled state.

FIG. 6 illustrates the equipment in a partially disassembled state. As can be seen, each of the elongate members 31*a* to *d*, 34*a* to *d* and 10 has been disconnected from adjacent elongate members and/or connectors. It can be seen that the sheaths 32*a* to 32*d* can be slid along the elongate members 31*a* to 31*d* to disassemble the elongate upper leg members 31 from the lower leg members 34*a* to 34*d*. Foot members 35*a* to 35*d* can also be disconnected from lower leg members 34*a* to 34*d* if desired, or could be permanently or semi-permanently connected. It will be appreciated that connectors 20 and 21 could remain connected to any one of the legs to which it connects, or the crossbar, while providing the benefits of the collapsibility of the invention by allowing the elongate members to be disconnected from one another.

As can be seen in FIG. 6, flexible connecting members 60 can be provided to retain all of the elongate components of the illustrated assembly as a connected disassembled set of elongate members. It is possible to provide a single flexible member 60 which connects foot 35*a* to 35*d*, for example, whilst passing via plural elongate leg members (34*a*, 31*a*, 31*d* and 34*d*, for example), through at least one of the connector members 20 or 21 and the crossbar 10. In this way, four feet and four legs can be connected via the crossbar 10 and connectors 20 and 21 using only two elongate flexible connecting members, preferably one flexible connecting member per pair of legs of the apparatus. A preferred embodiment may have two separate bungee cords, one connecting the front feet 35*a* to 35*d* and one connecting the back pair of feet 35*b* to 35*c*. Of course, one can equivalently connect 35*b* to 35*d* and a to c. It will further be appreciated, of course, that separate flexible connecting members could be provided individually to connect individual ends of the elongate members to one another, by connecting to the inside of the tubular members at each end, for example, although this could increase complexity and manufacturing costs. An advantage of the illustrated arrangement is that there is no need to connect the flexible retaining members to any component other than feet 35*a* to 35*d*, while the elongate members and crossbar connectors 20 and 21 are retained to the flexible members by being 'threaded' onto them, by the flexible members passing along an internal axis of each member. Retaining the disassembled parts to one another with flexible connecting members when disassembled allows the gym equipment to be disassembled and gathered for transport more easily.

Figure 7:
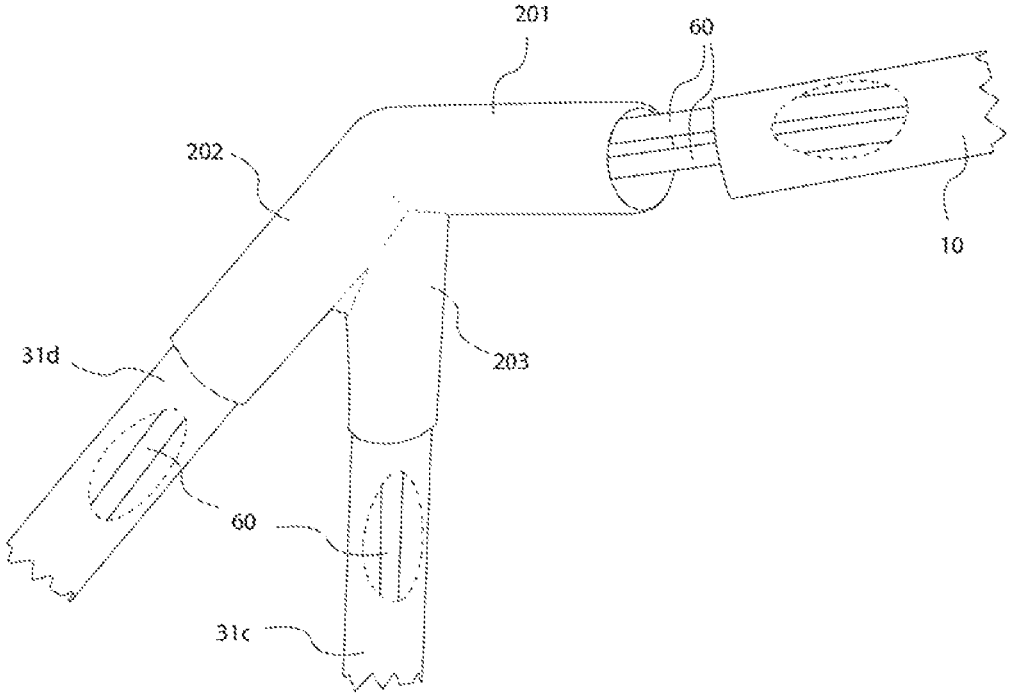
FIG. 7 shows detail of a connector arrangement for use in the invention.

FIG. 7 shows greater detail of a crossbar connector member 20. As can be seen, the connector member 20 has a crossbar receiving region 201. One or more leg receiving regions 202 and 203 may be provided. The leg and/or crossbar receiving regions 201 to 203 are preferably substantially tubular sections, having a form substantially corresponding to the cross-section of the tubular legs 30 and crossbar 10, respectively. The elongate members can then be assembled with the connector 20 by simply inserting an end into the tubular sections of the connector 20, or, conversely, in an alternative configuration, by inserting the connecting regions 201 to 203 of the connector member 20 into the respective tubular crossbar and leg members depending on the relative dimensions of each part.

The connection of the crossbar 10 by plugging into the tubular receiving portion 201 of connector 20 could be considered a plug-in connection. An alternative type of plug-in connection is where the connecting portion 201 of the connector 20 is sized and dimensioned to fit within the crossbar 10 to retain it to the connector 20.

Flexible retaining members 60 can be seen in the Figure, corresponding to those shown in FIG. 6. The flexible retaining members 60 may be configured such that they are elastic and may further be in tension even when the apparatus is in the assembled state. This means that the retaining members 60 can also act to bias the apparatus into its assembled state when assembled, so that elastic tension in the retaining member 60 has to be overcome in order to disassemble the apparatus. This can improve safety and also portability in the assembled state. Other means of securing the tubular members for the legs and crossbar into the connector 20 can be envisaged, such as bolts, screws, threaded compression elements, such as are used in plumbing equipment, bayonet style connections, etc.

Figure 8A:
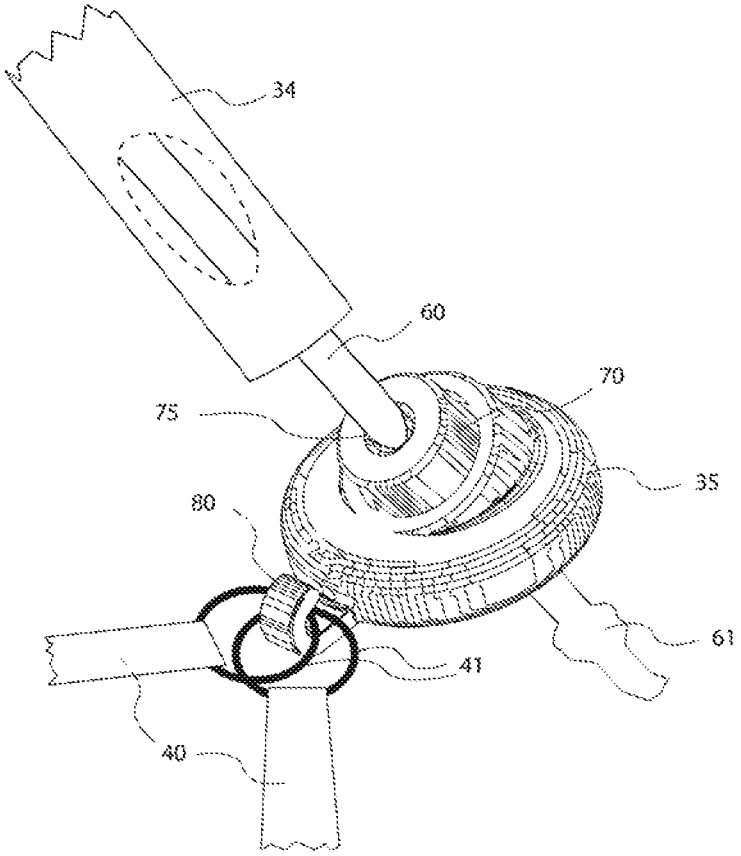
FIG. 8A shows detail of a foot member in the apparatus of the invention.

FIG. 8A shows detail of a foot member 35 of the assembly. It can be seen that the foot member 35 is provided with a leg member receiving portion 70, which is configured to engage the tubular leg member 34 shown in the Figure. This may be a plug-in type connection, so that the receiving portion of the foot member is received in the tubular member 34, or vice versa, as described in relation to the crossbar connectors 20 and 21. The foot member may also be provided with an opening 75 passing therethrough. The opening can allow the flexible retaining member 60 to pass through the foot member. As shown in the Figure, a knot 61 may be tied in the flexible retaining member 60. This, or any other means, may be used to provide a diameter increase in the retaining member 60 to prevent it passing through the opening 75 in the foot member 35. An attaching point 80 is also provided for attaching tension members 40 the foot member. Tension members 40 may be attached via rings 41, which are placed over a hook shaped attaching point 80 which is shown in the Figure. However, other forms of attachment for attaching the tension members 40 the foot member can be envisaged. The tension members may additionally or alternatively be attached directly to the leg members 30.

Figure 8B:
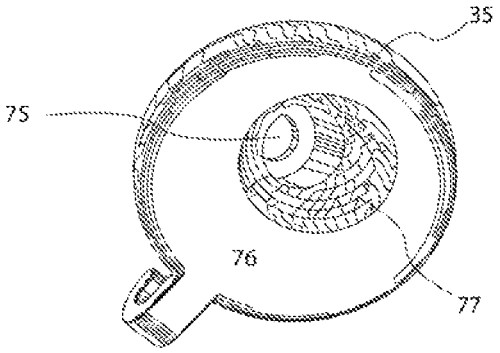
FIG. 8B shows a bottom view of the foot member of FIG. 7A.

FIG. 8B illustrates a bottom view of the foot member 35. It can be seen that the foot member 35 can comprise a cavity 77 adjacent the opening 75, so that the increased diameter portion 61 of the flexible member 60 can be received within a cavity of the foot member 35. The foot member can therefore provide a substantially flat base or bottom surface 76 for engaging the ground and the base may comprise a cavity for receiving an end stop of the flexible retaining member.

The foot member may have a substantially flat bottom surface 76 which is substantially opposite the leg member receiving portion 70. This allows the foot member to provide a substantially even and secure surface with engagement with the floor when the apparatus is standing on the floor in its assembled state. The leg member receiving portion may be configured to receive the leg member at an oblique angle, such as an angle above zero and below 90 degrees, or at 90 degrees, or substantially at 90 degrees, relative to the plane of the flat bottom 76 of the foot member 35.

Figure 9:
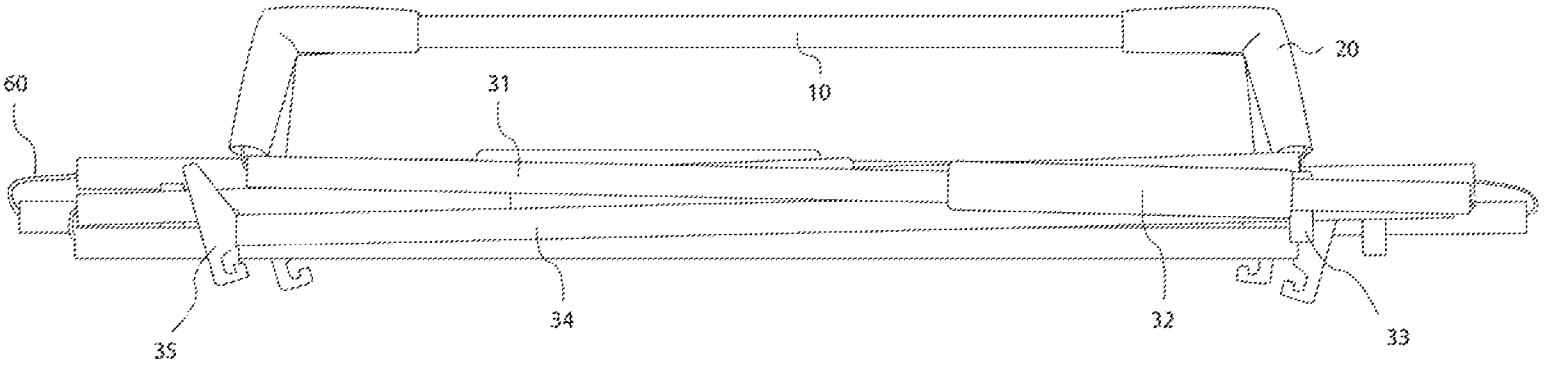
FIG. 9 shows the apparatus in a folded disassembled state.

FIG. 9 illustrates the apparatus of the preceding figures in its collapsed folded state. As can be seen in the figure, when collapsed, although still retained to one another via the flexible retaining members 60, each of the elongate members may be placed substantially parallel with one another which reduces the overall envelope of the apparatus by a significant amount as compared to its assembled state of FIG. 1. In the illustrated state, the overall length of the collapsed folded assembly is little more than the length of the crossbar. The overall envelope of the folded apparatus may be the maximum length of the longest elongate member of the apparatus, be it the upper or lower leg section or crossbar. Alternative embodiments can have upper and lower leg sections of the same lengths as illustrated, or of different lengths. Further, alternative embodiments may have legs that comprise three or more sections with two or more sheaths, instead of the two leg sections and one sheath per leg of the illustrated embodiments.

It will therefore be appreciated that the collapsible apparatus for bodyweight exercises according to the invention provides numerous advantages relating to its being adapted to moderately uneven surfaces, being usable in a range of different spaces without the need for secondary structures to which the crossbar should be attached. The assembly can be quickly and easily collapsed due to the straight forward and simple plug-in connections, flexible retaining members, and the sheath connections provided on the legs. Provision of the foot members with their various features, and the retaining straps, all contribute to the overall safety, adaptability and ease of deployment and stowage of the equipment before and after use.

The invention claimed is:

1. A collapsible apparatus for bodyweight exercises, arranged to be assembled into an assembled state and disassembled to a disassembled state, wherein, in the assembled state, the collapsible apparatus comprises a frame for the bodyweight exercises, the frame comprising:

a plurality of feet and a crossbar, the crossbar arranged to be held substantially horizontally at a height from a ground surface when the plurality of feet are located on the ground surface;

a plurality of legs each extending between one of the plurality of feet and the crossbar when the collapsible apparatus is in the assembled state; and at least two connectors in spaced configuration on the crossbar, for connecting the crossbar to at least one of the plurality of legs;

wherein at least one of the plurality of legs and/or the crossbar is detachable from at least one of the at least two connectors to disassemble the collapsible apparatus;

wherein in the disassembled state, the crossbar is retained to at least one of the plurality of legs by a flexible retaining member such that, when disassembled, the crossbar and the plurality of legs are retained to one another;

wherein the plurality of legs comprises a first pair of legs and a second pair of legs and, in the assembled state, each leg of the first and second pairs of legs extends away from a longitudinal axis of the crossbar in a substantially diagonal direction with respect to the longitudinal axis of the crossbar; and wherein the crossbar is configured to carry a weight of at least 50 kg.

2. The collapsible apparatus according to claim 1, wherein at least one first component of the collapsible apparatus is retained to at least one second component of the assembly by the flexible retaining member passing through an internal bore of at least one of the at least one first and the at least one second components of the collapsible apparatus.

3. The collapsible apparatus according to claim 2, wherein the plurality of legs are retained to the crossbar by the flexible retaining member passing through the internal bore of the plurality of legs.

4. The collapsible apparatus according to claim 1, wherein at least one of the plurality of feet is retained to a respective one of the plurality of legs by the flexible retaining member which also retains the respective one of the plurality of legs to the the crossbar.

5. The collapsible apparatus according to claim 1, wherein, in the assembled state, the frame comprises at least one tension member arranged to retain respective feet of at least one of the first and second pairs of legs at a substantially fixed distance from one another.

6. The collapsible apparatus according to claim 5, wherein the at least one tension member is a flexible strap.

7. The collapsible apparatus according to claim 1, wherein at least one of the plurality of feet comprises a leg receiving portion arranged to receive one of the plurality of legs, and an attachment portion, arranged for attaching a tension member to the at least one of the plurality of feet.

8. The collapsible apparatus according to claim 7, wherein the at least one of the plurality of feet comprises a first plug-in connection point for connecting to a tubular leg member.

9. The collapsible apparatus according to claim 7, wherein the at least one of the plurality of feet further comprises a hook section for attaching the tension member.

10. The collapsible apparatus according to claim 7, wherein the leg receiving portion is configured to receive the one of the plurality of legs of the collapsible apparatus at a non-perpendicular angle relative to a plane of a bottom surface of the at least one of the plurality of feet.

11. The collapsible apparatus according to claim 1, wherein the flexible retaining member comprises one or more elastic retaining members arranged to retain one or more first components of the collapsible apparatus to one or more second components of the collapsible apparatus.

12. The collapsible apparatus according to claim 11, wherein the one or more elastic retaining members are configured to bias the one or more first components and the one or more second components toward the assembled state when the collapsible apparatus is in the assembled state.

13. The collapsible apparatus according to claim 1, wherein at least one of the plurality of feet of the collapsible apparatus is retained to the flexible retaining member by a diameter increase provided on the flexible retaining member.

14. The collapsible apparatus according to claim 13, wherein the at least one of the plurality of feet comprises a cavity for receiving an end stop provided by the diameter increase of the flexible retaining member.

15. The collapsible apparatus according to claim 1, wherein one or more of the at least two connectors is configured to permit rotation of the at least one of the plurality of legs relative to at least one other of the plurality of legs, about the longitudinal axis of the crossbar.

16. The collapsible apparatus according to claim 15, wherein in the assembled state, the first pair of legs of the collapsible apparatus is able to rotate relative to the second pair of legs of the collapsible apparatus.

17. The collapsible apparatus according to claim 15, wherein the first pair of legs are held at relatively fixed orientations relative to one another while being able to rotate relative to the second pair of legs.

18. The collapsible apparatus according to claim 15, wherein the second pair of legs are held at relatively fixed orientations relative to one another.

19. The collapsible apparatus according to claim 1, wherein one or more of the plurality of legs extend diagonally away from a center region of the crossbar.

20. The collapsible apparatus according to claim 1, wherein in the assembled state, the frame comprises at least one tension member arranged to prevent outward splaying of the legs of each of the first and second pairs of legs when a user places weight on the crossbar such that the legs in each one of the first and second pairs of legs are retained at a substantially fixed distance from one another and from each leg of the other one of the first and second pairs of legs.

21. The collapsible apparatus according to claim 1 wherein, in the assembled state, each leg of the first and second pairs of legs extends diagonally away from the crossbar both in a fore-aft direction of the collapsible apparatus and in an outward lateral direction of the collapsible apparatus, such that the collapsible apparatus has a fore-aft footspan and a lateral footspan, the lateral footspan being greater than a length dimension of the crossbar.

* * * * *